US006327951B1

(12) United States Patent
Feld

(10) Patent No.: US 6,327,951 B1
(45) Date of Patent: Dec. 11, 2001

(54) MOUNTING ARRANGEMENT FOR HARD METAL CUTTING BLADES IN CUTTING HEADS

(75) Inventor: Harald Feld, Ehingen (DE)

(73) Assignee: Tigra Hartstoff GmbH, Oberndorf/Leoh (DE)

( * ) Notice: Subject to any disclaimer, the term of this patent is extended or adjusted under 35 U.S.C. 154(b) by 0 days.

(21) Appl. No.: 09/653,979

(22) Filed: Sep. 1, 2000

(51) Int. Cl.[7] ..... B26D 1/143

(52) U.S. Cl. ..... 83/698.01; 83/677; 83/836; 83/699.61

(58) Field of Search ..... 83/698.51, 840, 83/663, 677, 698.41, 698.61, 699.61, 699.51, 699.41, 699.31

(56) References Cited

U.S. PATENT DOCUMENTS 1,810,823 * 6/1931 Freas et al. ..... 83/699.61
3,032,152 * 5/1962 Titsler ..... 83/699.51
3,119,294 * 1/1964 Billingsley et al. ..... 83/698.61
3,935,774 * 2/1976 Craddy ..... 83/355
4,475,425 * 10/1984 Punater et al. ..... 83/700
5,224,408 * 7/1993 Steidinger ..... 83/674
5,282,409 * 2/1994 Rojas ..... 83/698
5,571,250 * 11/1996 Stegmaier ..... 83/698.41
5,890,410 * 4/1999 Hinojosa ..... 83/698.41
6,202,721 * 3/2001 Stegmaier ..... 83/698.41

* cited by examiner

*Primary Examiner*—Boyer Ashley
*Assistant Examiner*—Omar Flores-Sánchez
(74) *Attorney, Agent, or Firm*—Klaus J. Bach

(57) ABSTRACT

In a mounting arrangement for mounting a hard metal cutting blade in a cutting head in a mounting groove of the cutting head in an adjustable radial position, wherein the cutting blade is disposed on a support plate and engaged by a clamping bolt. The support plate includes a cut-out in which a profile plate having a tooth-like structure is received and the cutting blade includes a complimentary tooth-profile structure in engagement with the profile structure of the profile plate and an elastic insert is disposed in the cutout behind the profile plate for elastically biasing the profile structure of the profile plate into play-free engagement with the profile structure of the cutting blade when forced into engagement with one another by the clamping bolt and the clamping member.

9 Claims, 4 Drawing Sheets

MOUNTING ARRANGEMENT FOR HARD METAL CUTTING BLADES IN CUTTING HEADS

BACKGROUND OF THE INVENTION

The invention resides in a mounting arrangement for hard metal cutting blades in cutting heads for working wood or plastic materials.

Cutting heads for working wood or plastic materials are provided with exchangeable cutting blades of a hard metal. The cutting blades are clamped in position in corresponding recesses at the circumference of the cutting head body between a support plate and a clamping member. The support plate abuts, with its back surface, a support surface in the cutting head base body and extends radially beyond the circumference of the cutting head so as to support the cutting blade essentially over the whole surface area thereof. The clamping member is biased, by means of a tightening screw, against the front side of the cutting blade so as to firmly engage the cutting blade with the front side of the support plate.

To permit multiple sharpening of the cutting blade by grinding of its cutting edge, the blade must be supported so as to be radially adjustable. At the same time, it must be securely supported so as to prevent radial movement thereof or its radial expulsion at high operating speeds of the cutting head. It is therefore common practice to provide, at the backside of the cutting blade and at the front side of the support plate, complementary tooth profiles which fit into each other in several radial positions so that, when clamped in position, the cutting blade is engaged with the support plate in a form-fitting manner. The support plate is generally connected to the base body in a particular position by way of locking pins.

Another arrangement is shown for example in DE 92 13 466 V1. Here, a support plate is provided at its front side with teeth which engage a corresponding opposite profile at the backside of the cutting blade and the support plate is provided at its backside also with a tooth profile which cooperates with a corresponding tooth structure in the support surface of the base body.

It is furthermore known from DE GM 1693811 to provide for a form-locking radial engagement of the cutting blade by engaging tooth structures wherein the clamping member is provided with a tooth structure which is in engagement with a tooth structure provided at the front side of a tooth plate which is connected to the cutting blade by pins. A support plate is not provided in the cutting head disclosed in this publication.

The cooperation between the tooth profile structures on the cutting blade and on the support plate is critical to some degree since the radial play should be as small as possible in order to avoid engagement position errors of the cutting blade and since the cutting blade and the support plate need to be fully and tightly engaged with each other when mounted on the cutting head in order to prevent breakage of the cutting blade which is relatively brittle.

It is the object of the invention to provide a mounting arrangement for mounting hard metal cutting blades in cutting heads which provides for firm engagement of the cutting heads while reducing the chances of breakage.

SUMMARY OF THE INVENTION

In a mounting arrangement for mounting a hard metal cutting blade in a cutting head in a mounting groove of the cutting head in an adjustable radial position, wherein the cutting blade is disposed on a support plate and engaged by a clamping bolt. The support plate includes a cut-out in which a profile plate having a tooth-like structure is received and the cutting blade includes a complimentary tooth-profile structure in engagement with the profile structure of the profile plate and an elastic insert is disposed in the cutout behind the profile plate for elastically biasing the profile structure of the profile plate into play-free engagement with the profile structure of the cutting blade when forced into engagement with one another by the clamping bolt and the clamping member.

The arrangement is simple and easy to manufacture and provides for a play-free abutment of the cutting blade on the support plate.

The invention is described below in greater detail on the basis of the accompanying drawings.

DESCRIPTION OF A PREFERRED EMBODIMENT

Figure 1A:
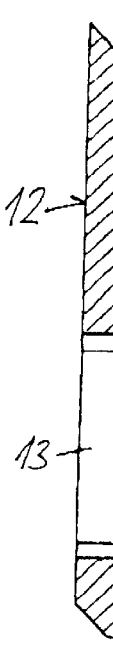
FIG. 1A shows, in a cross-sectional view, a support plate for supporting a cutting blade in a cutting head.
Figure 1B:
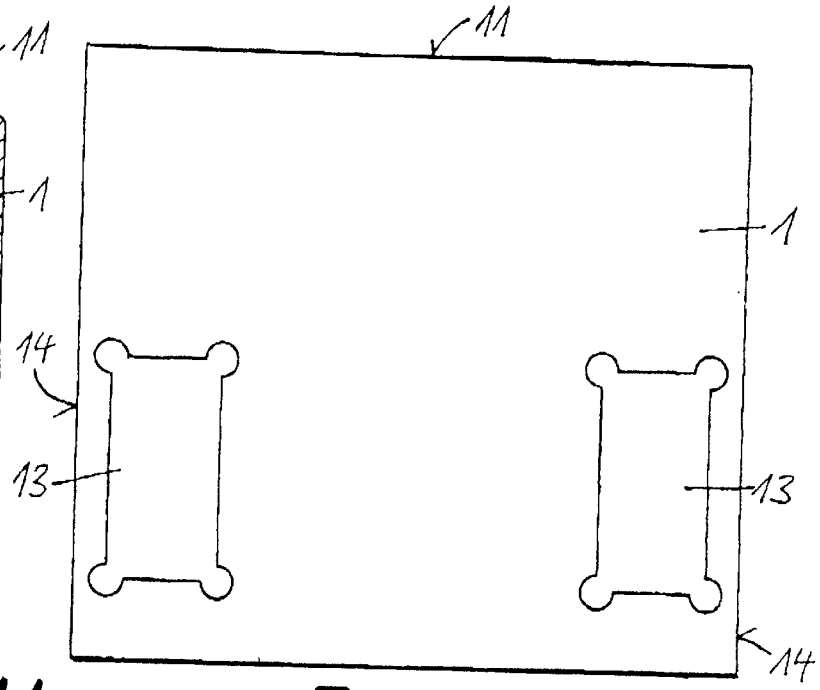
FIG. 1B is a side view of the support plate shown in FIG. 1A.

The FIGS. 1A and 1B show an embodiment of a support plate 1, wherein the support plate 1 has, at its outer end 11, a shape corresponding to that of the cutting blade 2. At its front side 12 on which the cutting blade 2 is supported, the support plate 1 includes two rectangular recesses 13 with flat bottom walls.

Figure 2A:
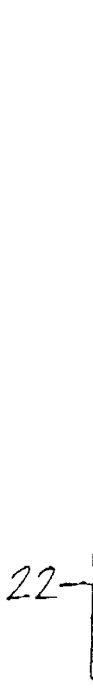
FIG. 2A shows a cutting blade in a cross-sectional view.
Figure 2B:
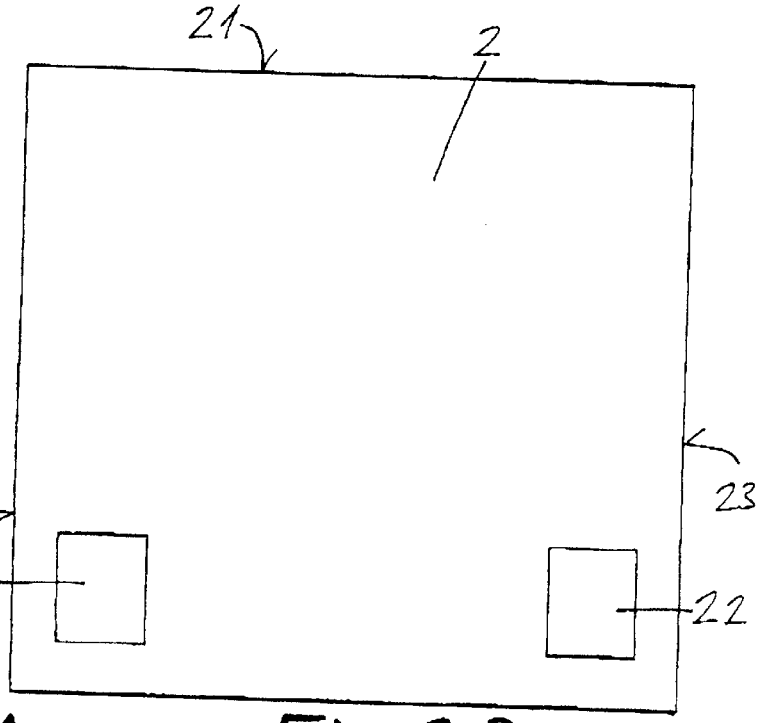
FIG. 2B is a side view of the cutting blade shown in FIG. 2A.

FIGS. 2A and 2B show a hard-metal cutting blade 2, in a cross-sectional and in a plain view, with a radially outer cutting edge area 21 and two rectangular openings 22 formed into the radially inner area thereof.

The rectangular openings 22 of the cutting blade 2 and the rectangular recesses 13 of the support plate 1 are arranged each close to the opposite side edges 14 of the support plate 1 and, respectively, the cutting blade 2. The rectangular recesses 13, which are also arranged in the radially inner area of the support plate 1 (the definition "radial" refers to the axis of the cutting head and indicates therefore a length normal to the cutting edge area 21 of the cutting blade 2 or respectively, the edge area 11 of the support plate 1) have a larger radial width than the openings 22 of the cutting plate 2. Furthermore, the recesses 13 are somewhat wider than the openings 22 so that, when the cutting blade 2 and the support plate 1 are disposed on one another, the openings 22 of the cutting blade 2 are overlapped by the recesses of the support plate over a certain radial displacement range wherein the openings 22 remain within the circumference of the recesses 13 of the support plate 1.

Instead of two recesses 13 and, respectively, openings 22 in the support plate 1 and in the cutting blade 2 a single recess 13, and respectively, opening 22 may be provided in the support plate 1 and the cutting blade 2.

Figure 3:
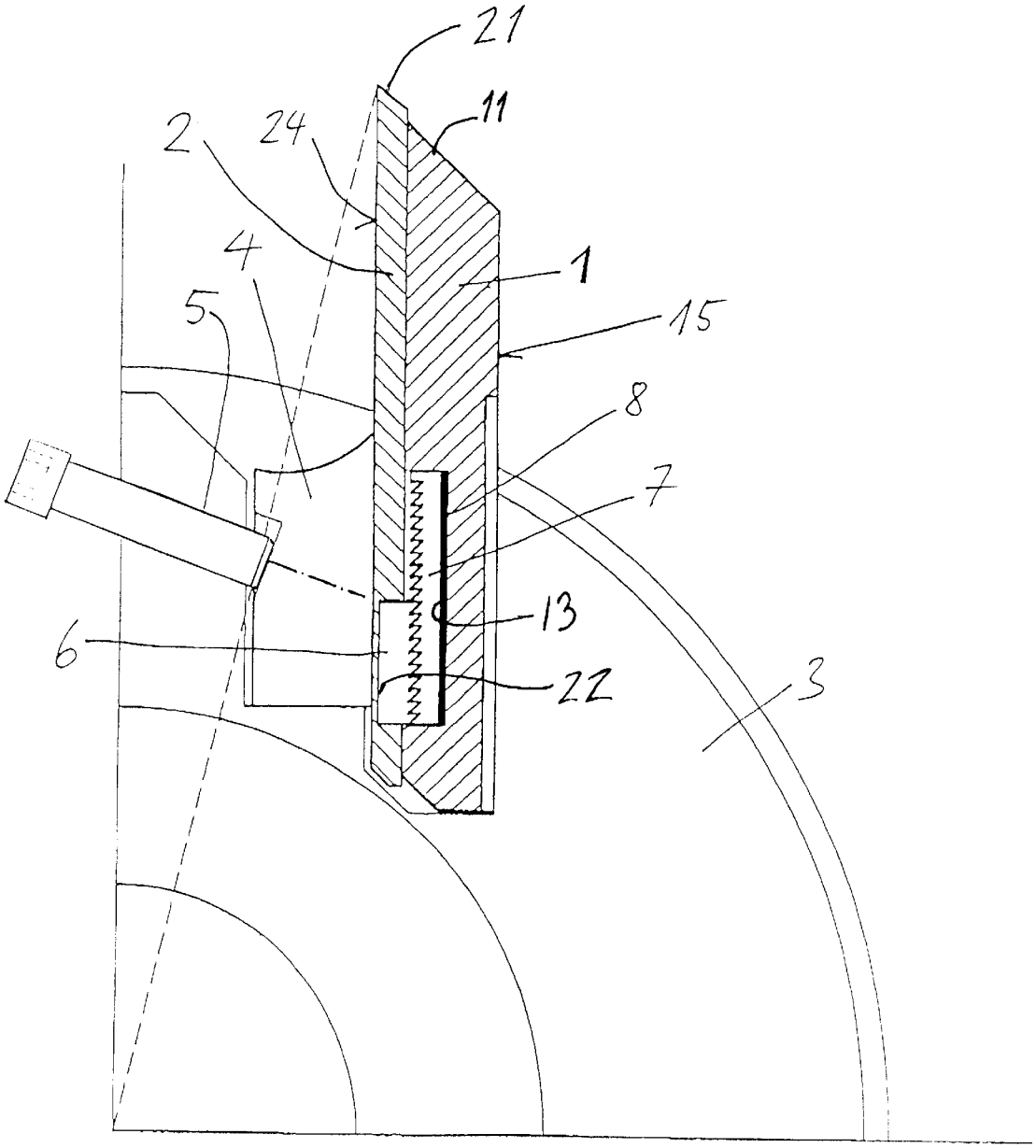
FIG. 3 is a partial cross-sectional view of a cutting blade supported in a cutting head.
Figure 4:
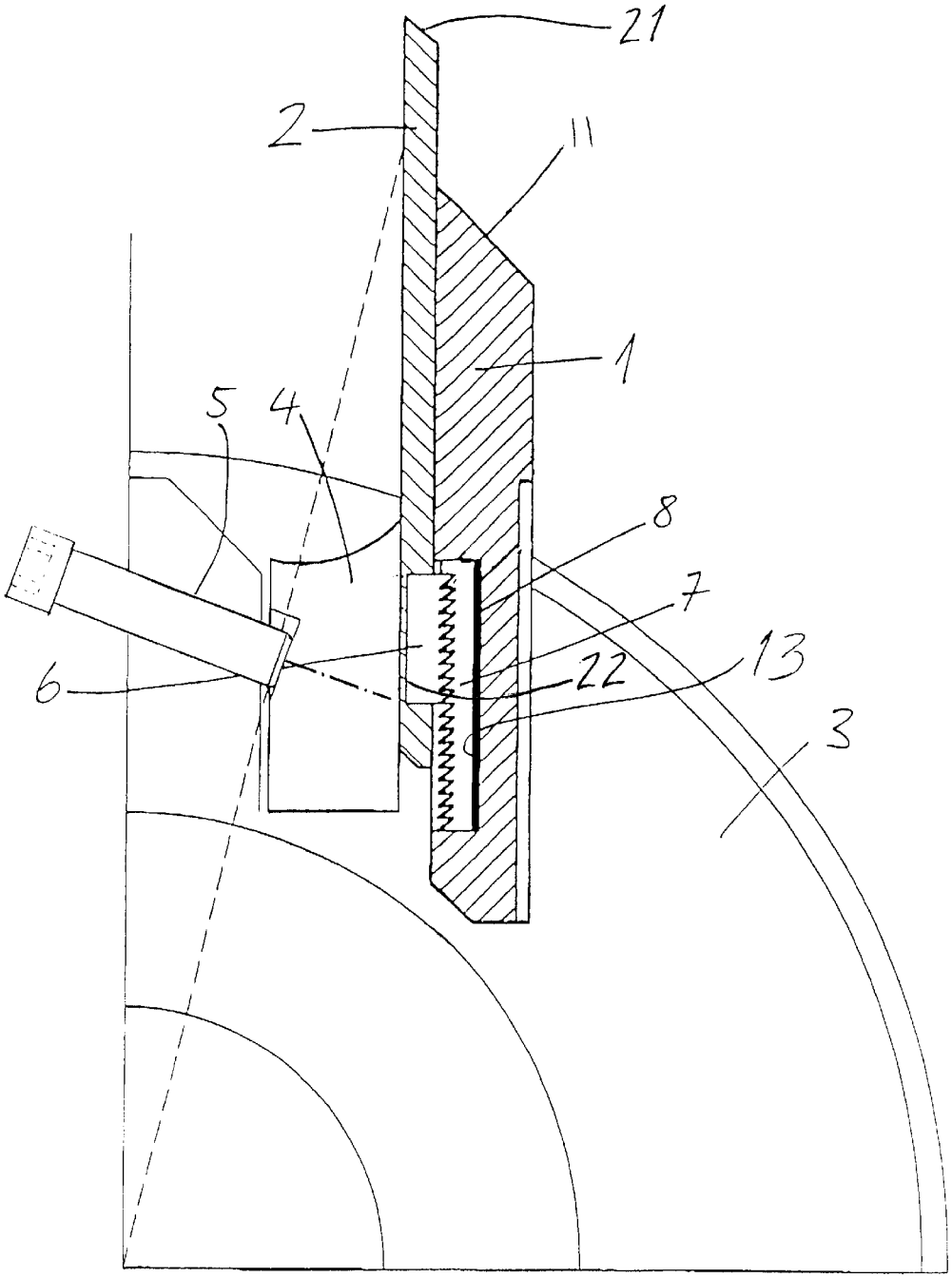
FIG. 4 shows the arrangement of FIG. 3, wherein however the cutting blade is in its outermost end position.

FIGS. 3 and 4 show schematically a part of the cutting head 3 with the cutting blade mounting arrangement according to the invention shown partially in cross-section. FIG. 3 shows the mounting arrangement for the cutting blade 2 in its radially innermost position and FIG. 4 shows the mounting arrangement with the cutting blade in its radially outermost position within the adjustment range. It is to be understood that FIG. 4 is only a theoretical representation since, practically, when the cutting blade is in the shown outermost position it has been sharpened already several times so that its radially outer end, that is, its cutting edge 21, actually projects radially beyond the support plate 1 only as much as it is shown for FIG. 3.

In FIGS. 3 and 4, wherein the cutting blade 2 and the support plate 1 are again shown in cross-section, the support plate 1 is shown supported, with its backside 15 on a corresponding support surface formed in the cutting head 3. An engagement member 4, which is engaged by a clamping bolt 5, that is indicated by a dash-dotted center line, is also shown only schematically. It abuts the front side 24 of the cutting blade 2 so as to firmly engage the cutting blade 2 with the support plate 1.

In each opening 22 of the cutting blade 2, there is disposed a small block 6 provided at its backside with a saw-tooth-like structure and in each rectangular recess 13 of the support plate, there is disposed a profile plate 7 which, at its front-side is provided with a saw-tooth structure complementary to the saw-tooth like structure of the block 6. Between the profile plate 7 and the bottom wall of the respective recess 13 of the support plate 1, there is a resilient insert 8 for example in the form of a compressible rubber plate or a leaf spring.

There is a discrepancy between FIGS. 3 and 4 and FIG. 2A insofar as, in FIG. 2A, the openings 22 in the cutting blade 2 are shown as windows whereas these openings are shown in FIG. 3 and 4 as recesses extending through the larger part of the cutting blade thickness but leaving a bottom wall. Either embodiment may be used.

As it is apparent from FIGS. 3 and 4, the tooth profile on the small block 6 and on the profile plates 7 is so formed that the cooperating tooth flanks which are forced into engagement with one another by the centrifugal forces acting on the cutting blade 1 during rotation of the cutting head extend transverse to the direction of the centrifugal forces. The small blocks 6 then exert on the profile plates only forces which extend exactly in the plane of the cutting blade 2. They do not at the same time exert force components in the direction of the pretensioning force of the elastic insert 8 and in a direction opposite thereto.

The support plate 1 is of course secured to the cutting head 3 in the usual manner by pins or in another suitable way, which is not shown in the schematic drawing.

With the arrangement shown and described herein a playfree and consequently accurate form-locking radial cutting blade position adjustment on the support plate 1 is achieved.

Finally, it is pointed out that the arrangement according to the invention can also be realized if the cutting blade 2 is provided, in a conventional way, at its backside with a saw-tooth profile which is formed into the cutting blade. However, the arrangement as proposed herein with small blocks 6 disposed in the openings 22 of the cutting plate 2 facilitates the manufacturing and is therefore more advantageous.

Figure 5:
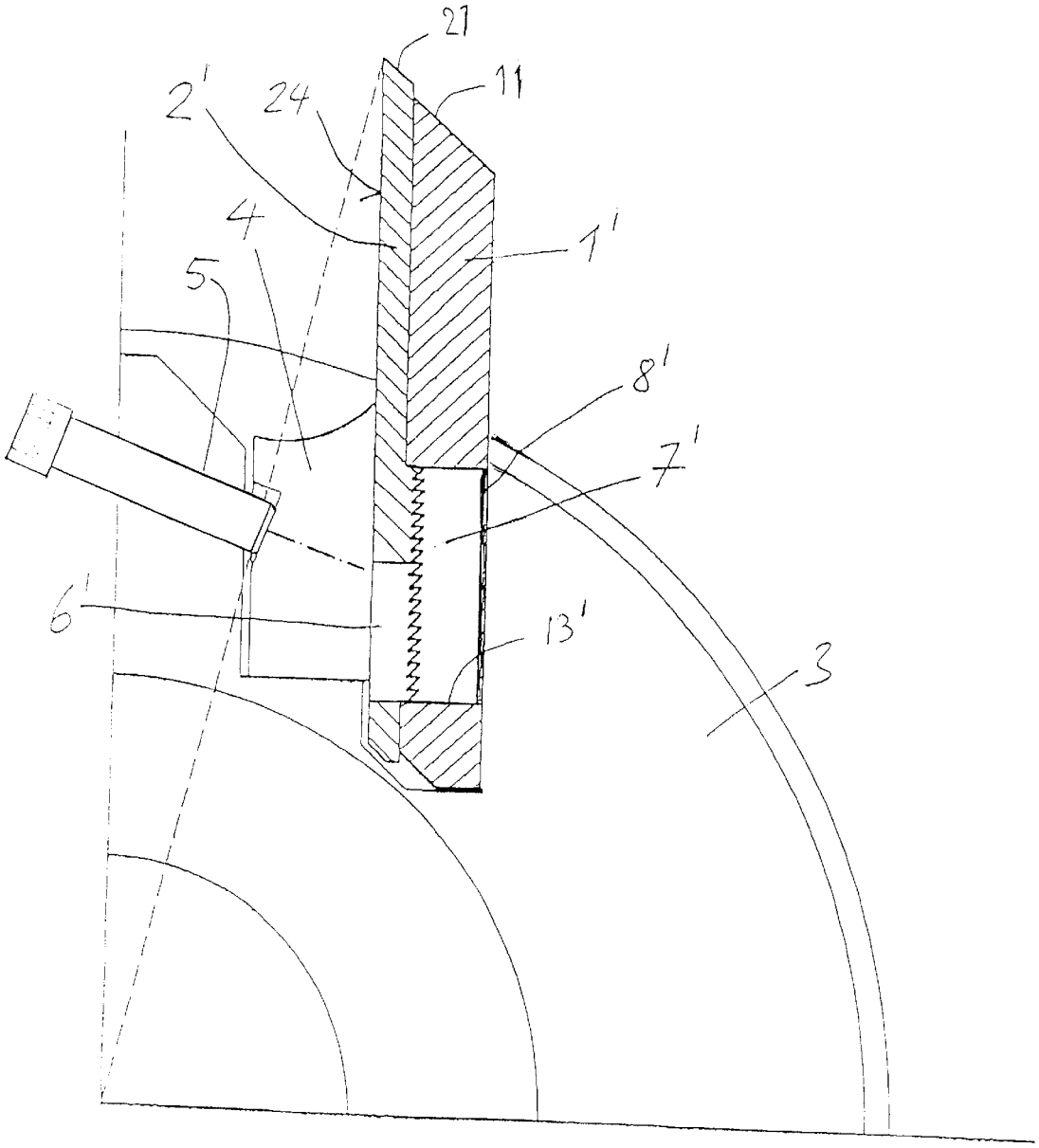
FIG. 5 shows another embodiment for supporting the cutting blade.

It is further noted that, instead of recesses 13, the support plate 1 may include openings 13' extending through the plate l' and each profiled plate 7' may abut directly the support surface of the cutting head 3 by way of the elastic insert 8' as indicated in FIG. 5, which is otherwise identical to FIG. 4 and in which the same reference numerals are used to indicate the same structures as in FIG. 4. Also, the opening in the cutting blade 2' may be a window and the small block 6' is disposed in the window and abuts directly the clamping member 4.

What is claimed is:

1. A mounting arrangement for a hard metal cutting blade in a mounting groove formed in a cutting head in radial positions which are adjustable in steps, said mounting groove having flat front and rear walls, comprising: a support plate disposed in said mounting groove with one side thereof, adjacent the rear wall thereof and being connected thereto in formlocking relationship, said hard metal cutting blade being disposed in abutment with the other side of said support plate, a clamping member disposed in said cutting head adjacent said cutting blade and a clamping bolt mounted in said cutting head for biasing said clamping member against said cutting blade and said cutting blade into firm engagement with said support plate, said support plate including a cut-out, a profile plate provided with a tooth structure disposed in said cut-out and said cutting blade including a complementary tooth profile structure in engagement with the profile-structure of said profile plate, and an elastically resilient insert disposed in said cut-out behind said profile plate for elastically biasing the profile structure of said profile plate into play-free engagement with the profile structure on said cutting blade when forced into engagement with one another by said clamping bolt and said clamping member.

2. A clamping arrangement according to claim 1, wherein said elastically resilient insert is a compressible rubber plate.

3. A clamping arrangement according to claim 1, wherein said elastically resilient insert is a leaf spring.

4. A clamping arrangement according to claim 1, wherein said cut-out in said support plate is a flat rectangular recess with a flat bottom wall.

5. A clamping arrangement according to claim 1, wherein said cut-out in said support plate is a window extending fully through said support plate and the one side of the mounting groove forms the support wall for said elastically resilient insert.

6. A clamping arrangement according to claim 1, wherein the teeth of the tooth structures of said cutting blade have cooperating tooth flanks with surfaces which extend perpendicularly to the side surfaces of the cutting blade.

7. A clamping arrangement according to claim 1, wherein said tooth profile structure of said cutting blade is disposed on the front side of said cutting blade and said profile plate is disposed in a recess formed in the clamping member.

8. A clamping arrangement according to claim 1, wherein said complementary tooth profile structure of said cutting blade is formed on a separate block element received in an opening formed in said cutting blade.

9. A clamping arrangement according to claim 8, wherein said opening in said cutting blade is a window extending through said cutting blade and said block element which is provided at one side with a tooth structure is engaged at the other side thereof by said clamping member.

* * * * *